United States Patent [19]

Sando et al.

[11] Patent Number: 4,571,962

[45] Date of Patent: Feb. 25, 1986

[54] APPARATUS FOR CONTINUOUS LIQUID TREATMENT OF A CLOTH

[75] Inventors: Yoshikazu Sando; Hiroshi Ishidoshiro, both of Wakayama, Japan

[73] Assignee: Sando Iron Works Co., Ltd., Japan

[21] Appl. No.: 620,106

[22] Filed: Jun. 13, 1984

[30] Foreign Application Priority Data

Jun. 16, 1983 [JP] Japan ..... 58-108364

[51] Int. Cl.[4] ..... D06B 3/12

[52] U.S. Cl. ..... 68/5 E; 68/62; 68/175; 68/212; 118/70; 118/429

[58] Field of Search ..... 68/5 E, 13 R, 62, 175, 68/212; 134/62, 78, 120, 150; 118/70, 429

[56] References Cited

U.S. PATENT DOCUMENTS

| | | | |
|---|---|---|---|
| 1,771,698 | 7/1930 | Wolff | 118/429 X |
| 2,857,878 | 10/1958 | Matson et al. | 118/429 X |
| 3,032,817 | 5/1962 | Czerkas | 118/429 X |
| 3,445,262 | 5/1969 | Greck et al. | 118/70 X |
| 4,009,681 | 3/1977 | Heckman et al. | 118/70 |

*Primary Examiner*—Philip R. Coe
*Assistant Examiner*—Frankie L. Stinson
*Attorney, Agent, or Firm*—Toren, McGeady, Stanger, Goldberg & Kiel

[57] ABSTRACT

An apparatus for continuous liquid treatment of a cloth comprising a treating solution soaking tank (A) provided at a position adjacent to a cloth inlet of a steamer body (B), through which a cloth 2 to be treated is continuously transported for wet-heat treatment, said treating solution soaking tank (A) including:

a fixed tank 5 fitted with a cloth guide roll 7;

a movable tank 4 having a wall surface adjacent to the wall surface of the fixed tank 5 for forming a cloth passage 6 of a cloth to be treated therebetween;

a cylinder 13 for turning the movable tank 4;

treating solution supply pipes 8 for supplying a treating solution successively to the cloth passage 6; and washing showers 12 for jetting washing water to the cloth passage 6. The exchange of a treating solution in the treating solution soaking tank can be done speedily and effectively with no need of interrupting the transportation of the cloth prior to the wet-heat treatment of the cloth in the steamer body.

1 Claim, 2 Drawing Figures

APPARATUS FOR CONTINUOUS LIQUID TREATMENT OF A CLOTH

BACKGROUND OF THE INVENTION

1. Field of the Invention

The present invention relates to an apparatus for continuous liquid treatment of a long cloth soaked with a prescribed treating solution for a continuous wet-heat treatment comprising a treating solution soaking tank for facilitating exchange of the treating solution to be applied to the cloth.

2. Description of the Prior Arts

In subjecting a long cloth produced commercially to continuous treatments such as pretreatment and dyeing, it has been a common practice to soak the cloth with a treating solution (for instance, in a caustic alkali solution in pretreatment and a dye solution in dyeing) in a continuous manner with the use of a treating solution soaking tank in a treating solution soaking step and to subject the resultant cloth to continuous wet-heat treatment with the use of a steamer in a wet-heat treating step.

In such a continuous treatment of a long cloth, it is frequently required to exchange the treating solution for achieving different kinds of treatment or different colors in the course of the treatment of a prescribed length of the cloth. To speak practically, for instance, it is often required to change color for every prescribed length of the cloth during the dyeing treatment of a long cloth. However, for dyeing with different colors, it has been necessary for the conventional processes to interrupt the transportation of the cloth through the treating solution soaking tank and the steamer as well as the supply of wet-heat in the steamer for cleansing the interior of the treating solution soaking tank every time in changing the dye solution in the treating solution soaking tank and to resume the transportation of the cloth again after the dye solution is exchanged. Accordingly, there occur such drawbacks that the productivity is decreased due to the interruption of the treatment and further that no uniform dyeing can be achieved all over the cloth due to the fluctuation of the wet-heat treating condition in the steamer.

SUMMARY OF THE INVENTION

Under such circumstances, the object of the present invention is to offer an apparatus for continuous liquid treatment of a cloth, which comprises a new treating solution soaking tank for facilitating the exchange of the treating solution in the treating solution soaking tank speedily and effectively with no need of interrupting the transportation of the cloth prior to the wet-heat treatment of the cloth in a steamer body.

The treating solution soaking tank according to the present invention comprises a fixed tank fitted with a cloth guide roll, a movable tank having a cloth passage between the movable tank and the fixed tank, a cylinder for turning the movable tank, treating solution supply pipes to the cloth passage and washing showers for jetting washing water to the cloth passage.

BRIEF EXPLANATION OF THE DRAWINGS

The drawings are to show an example of the present inventive apparatus for continuous liquid treatment of a cloth.

DETAILED DESCRIPTION OF THE INVENTION

The present invention will be described in detail in the following with reference to the drawings showing an example of the inventive apparatus.

Figure 1:
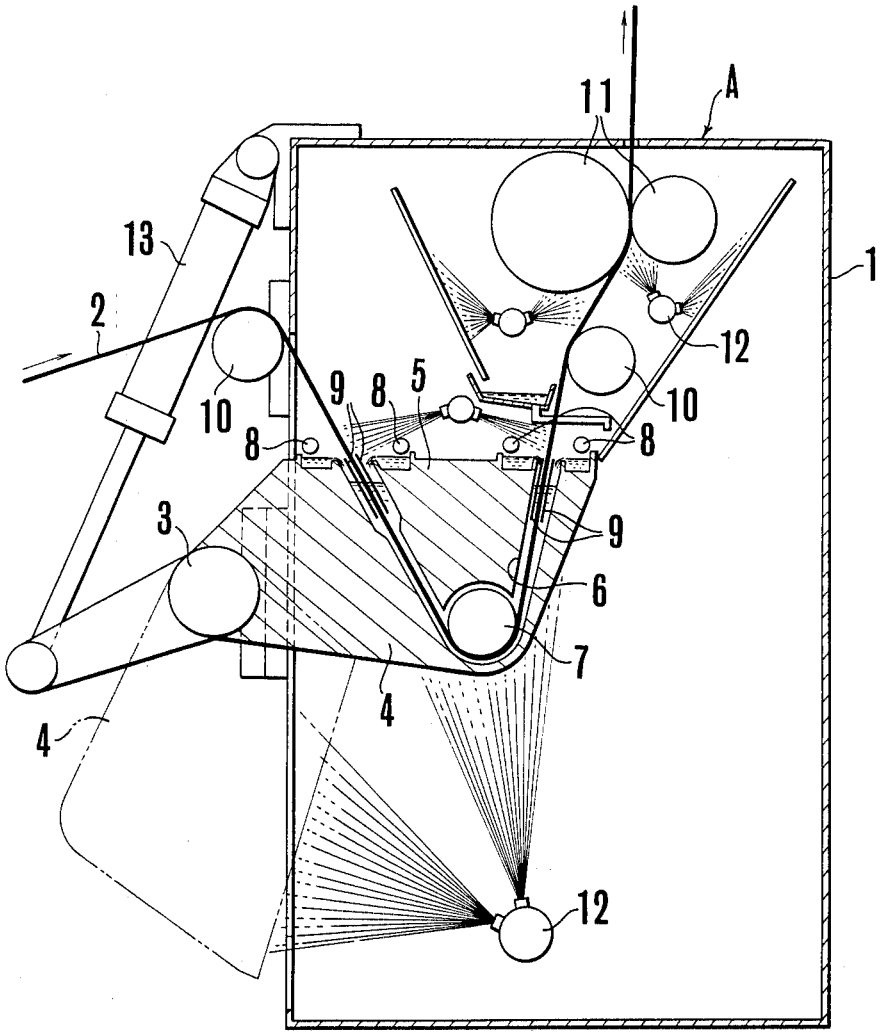
FIG. 1 is an explanatory drawing of the treating solution soaking tank of the apparatus.

The construction of a treating solution soaking tank (A) will be described in the first place. In FIG. 1, 1 is an outer wall of the treating solution soaking tank (A) through which a cloth 2 to be soaked with a treating solution is transported continuously. In the interior of the outer wall 1, a movable tank 4, which is supported by a rotatable support shaft 3, and a fixed tank 5 corresponding to the movable tank 4 are provided for forming a nearly V-shaped cloth passage 6 therebetween. 7 is a cloth guide roll provided rotatably at the lower end of the fixed tank 5. 8 represents treating solution supply pipes for supplying a prescribed amount of the treating solution constantly to the cloth passage 6, and 9 represents foam extinguishing plates provided near the inlet and the outlet of the cloth passage 6. 10 represents cloth guide rolls for taking in and out of the cloth to and from the cloth passage 6, and 11 is a pair of squeeze rolls for squeezing the treating liquid from the cloth. 12 represents a plurality of washing showers provided at suitable positions in the interior of the outer wall 1 so as to effectively wash the surface of parts such as the fixed tank 5, movable tank 4, treating solution supply pipes 8, cloth guide rolls 10 and squeeze rolls. 13 is a cylinder for turning the movable tank 4.

Figure 2:
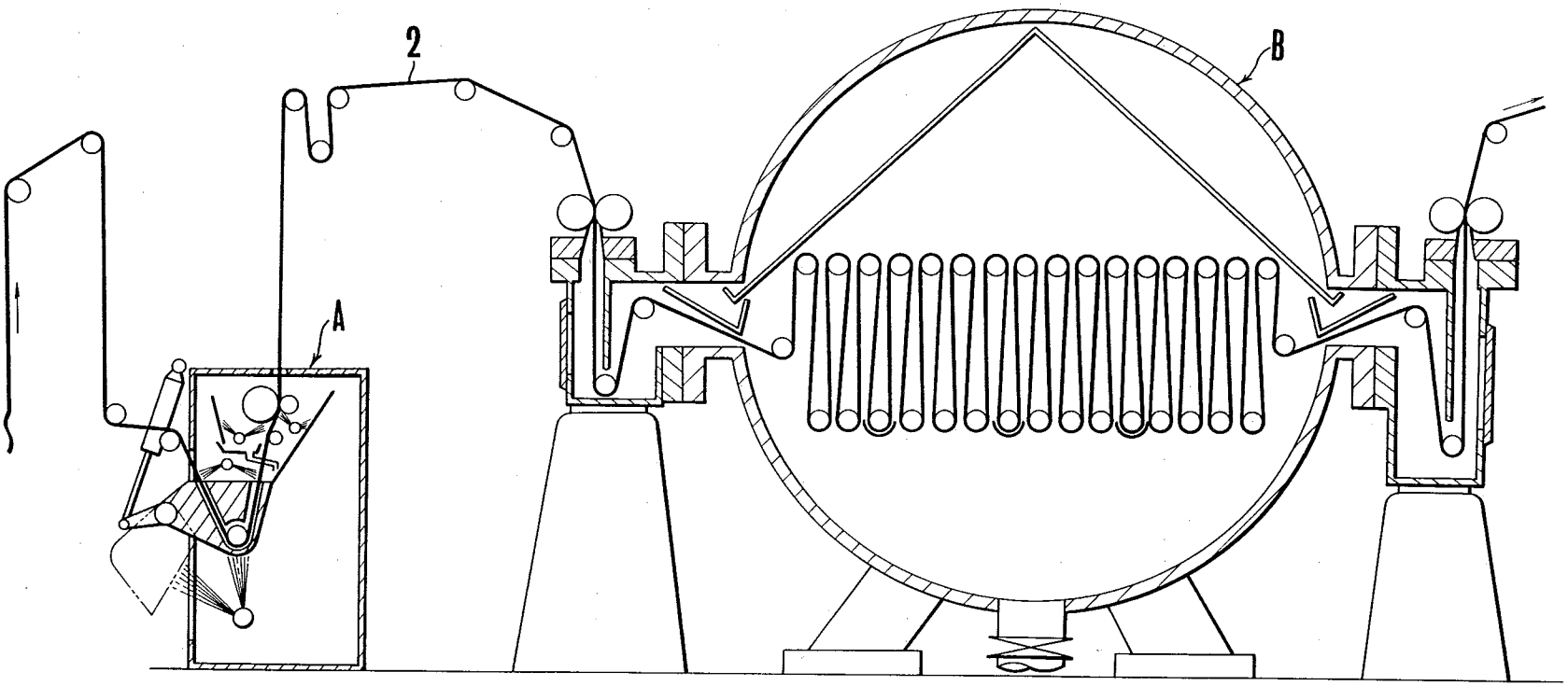
FIG. 2 is an explanatory drawing showing the total construction of the apparatus.

The construction of the treating solution soaking tank (A) in this example is as described above. As shown in FIG. 2, such a treating solution soaking tank (A) is provided adjacent to the cloth inlet of a steamer body (B) for wet-heat treating the cloth by transporting the cloth 2 soaked with a sufficient amount of the treating solution continuously therethrough, and thus the treatment of a cloth in object can be completed. While the steamer body (B) shown in this drawing is of a high pressure type, the steamer body is not limited thereto. Any steamer body which can transport a cloth continuously therethrough for wet-heat treatment of the cloth can sufficiently be employed, and both a high pressure steamer and an ordinary pressure steamer may selectively be used.

The construction of the apparatus for continuous liquid treatment of a cloth this example is as described in above. Now, continuous liquid treatment of a long cloth by using the apparatus in this example will be described in the following.

At first, in the treating solution soaking tank (A), by pushing out the piston of the cylinder 13, the movable tank 4 is transferred to the position as shown with a solid line in the drawing for forming the V-shaped cloth passage 6 between the movable tank 4 and the fixed tank 5. Then, a cloth 2 to be treated is continuously transported through the cloth passage 6 while pouring a treating solution from the treating solution supply pipes 8 successively to the cloth in the cloth passage 6. The treating solution is sufficiently supplied as the cloth is transported through the cloth passage 6, and the treated cloth is successively supplied into the steamer body (B) for satisfactory wet-heat treatment therein.

For exchanging the treating solution in the treating solution soaking tank (A), the cylinder 13 is operated for moving the movable tank 4 to a position as shown with a chain line in the drawing without stopping the transportation of the cloth. Then the V-shaped cloth passage 6 is opened, and the treating solution remaining in the interior of the movable tank 4 or the cloth passage 6 can be discharged. By reducing the inner volume of the cloth passage 6 to an amount as small as possible in the range where the transportation of the cloth is not hindered, the amount of residual solution to be discharged can be reduced to minimum. Then washing water is jetted from each of the washing showers 12 for blowing the washing water onto the surface of parts such as the fixed tank 5, movable tank 4, cloth guide roll 7 and squeeze rolls 11 for effectively washing thereof in a short time. When the cleansing of the treating solution soaking tank (A) is completed in this way, the movable tank 4 is closed for regenerating the cloth passage 6, and a new treating solution is supplied from the treating solution supply pipes 8 into the cloth passage 6. Thus, continuous liquid treatment of a long cloth can effectively be done varying the kinds of treating solution.

In applying the present inventive apparatus to liquid treatment of a cloth, the cleansing of the interior of the treating solution soaking tank (A) and the exchange of the treating solution therein can effectively and speedily be done due to the effect of the opening of the movable tank 4 by the operation of the cylinder 13 and the jetting of the cleansing water with no need of stopping continuous transportation of the cloth. Accordingly, there is also no need of stopping the operation of the steamer body (B), and it is possible to maintain the wet-heat condition in the steamer body constant for producing a product of uniform quality speedily and efficiently.

What we claim:

1. An apparatus for continuous liquid treatment of a cloth comprising a steamer body including a cloth inlet, a treating solution soaking tank (A) provided at a position adjacent to the cloth inlet of said steamer body (B), through which a cloth 2 to be treated is continuously transported for wet-heat treatment, said treating solution soaking tank (A) including:

a fixed tank 5 fitted with a cloth guide roll 7;

a movable tank 4 having a wall surface adjacent to the wall surface of the fixed tank 5 for forming a cloth passage 6 of the cloth to be treated therebetween;

a cylinder 13 for turning the movable tank 4;

treating solution supply pipes 8 for supplying a treating solution successively to the cloth passage 6; and washing showers 12 for jetting washing water to the cloth passage 6.

* * * * *